United States Patent [19]

Bailey et al.

[11] 4,340,121

[45] Jul. 20, 1982

[54] PNEUMATIC ROCK DRILLS

[75] Inventors: Edward A. Bailey, Newport; Louis H. LeBlanc, Jr., Claremont, both of N.H.

[73] Assignee: Joy Manufacturing Company, Pittsburgh, Pa.

[21] Appl. No.: 110,587

[22] Filed: Jan. 9, 1980

[51] Int. Cl.[3] ..... B25D 9/18

[52] U.S. Cl. ..... 173/134; 91/325

[58] Field of Search ..... 173/134; 91/232, 234, 91/325

[56] References Cited

U.S. PATENT DOCUMENTS

| | | | |
|---|---|---|---|
| 1,264,217 | 4/1918 | Smith | 173/134 |
| 1,355,175 | 10/1920 | Smith | 91/232 |
| 1,401,003 | 12/1921 | Smith | 173/134 X |
| 2,045,945 | 6/1936 | Carr | 91/232 X |
| 3,685,593 | 8/1972 | Amtsberg et al. | 173/105 X |
| 3,983,788 | 10/1976 | Andersson et al. | 91/325 |
| 4,282,937 | 8/1981 | Hibbard | 91/232 X |
| 4,287,810 | 9/1981 | Thoma | 91/325 X |

FOREIGN PATENT DOCUMENTS

| | | | |
|---|---|---|---|
| 856238 | 12/1960 | United Kingdom | 173/134 |
| 1067691 | 5/1967 | United Kingdom | 173/134 |

*Primary Examiner*—Werner H. Schroeder
*Assistant Examiner*—Andrew M. Falik
*Attorney, Agent, or Firm*—Buell, Blenko, Ziesenheim & Beck

[57] ABSTRACT

A pneumatic motor for rock drills and the like having a reciprocating piston with valves at its opposite ends for valving motive air to the piston head from both ends of the cylinder. Large receivers are provided near the respective valves to accommodate availability of air on demand from the valves and to dampen pressure fluctuations. One of the receivers is connected to an external source of fluid under pressure; while the two receivers are interconnected by tubing external to the pneumatic motor itself. This permits the cylinder for the piston to comprise a simple tube provided with exhaust ports only. Additionally, exhaust air and oil from an air motor, which rotates the rock drill, are directed into the area between the lower end of the reciprocating piston and a striking bar for the drill rod to lubricate the reciprocating parts.

4 Claims, 4 Drawing Figures

PNEUMATIC ROCK DRILLS

BACKGROUND OF THE INVENTION

In the past, pneumatic motors for rock drills and the like have been provided wherein the hammer piston includes reduced-diameter portions extending axially on opposite sides of an enlarged central piston portion. The reduced-diameter portions include reduced area sections which act as inlet valve means for valving motive air to the piston head from both ends of the cylinder. One example of such a pneumatic motor can be found by reference to U.S. Pat. No. 1,264,217, issued Apr. 30, 1918.

Pneumatic motors of the aforesaid type usually have bores extending along the cylinder wall for connecting the inlet valve means at one end of the cylinder to the other and for connecting both valve means to a fluid pressure source. As a result, the machining and assembly of such pneumatic motors are relatively expensive and complicated.

SUMMARY OF THE INVENTION

In accordance with the present invention, a new and improved pneumatic motor is provided having valve means incorporated into each side of a reciprocating piston but wherein minimum machining of the cylinder which houses the piston is required since it comprises a simple tube provided with the exhaust ports only. Communication between the valve means at opposite ends of the cylinder is achieved through the use of external tubing interconnecting relatively large receivers located near the valve means to dampen pressure fluctuations and insure availability of air under pressure.

Further, and in accordance with the invention, a pneumatic motor, rotating rock drill assembly is provided wherein exhaust air and oil from an air motor which rotates the drill chuck are directed only into the area between the reciprocating piston and a striking bar for the drill rod to lubricate the striking bar. The gearing interconnecting the air motor and the rotary drill rod is housed within a closed gearbox containing a lubricant.

The above and other objects and features of the invention will become apparent from the following detailed description taken in connection with the accompanying drawings which form a part of this specification, and in which.

Figure 1:
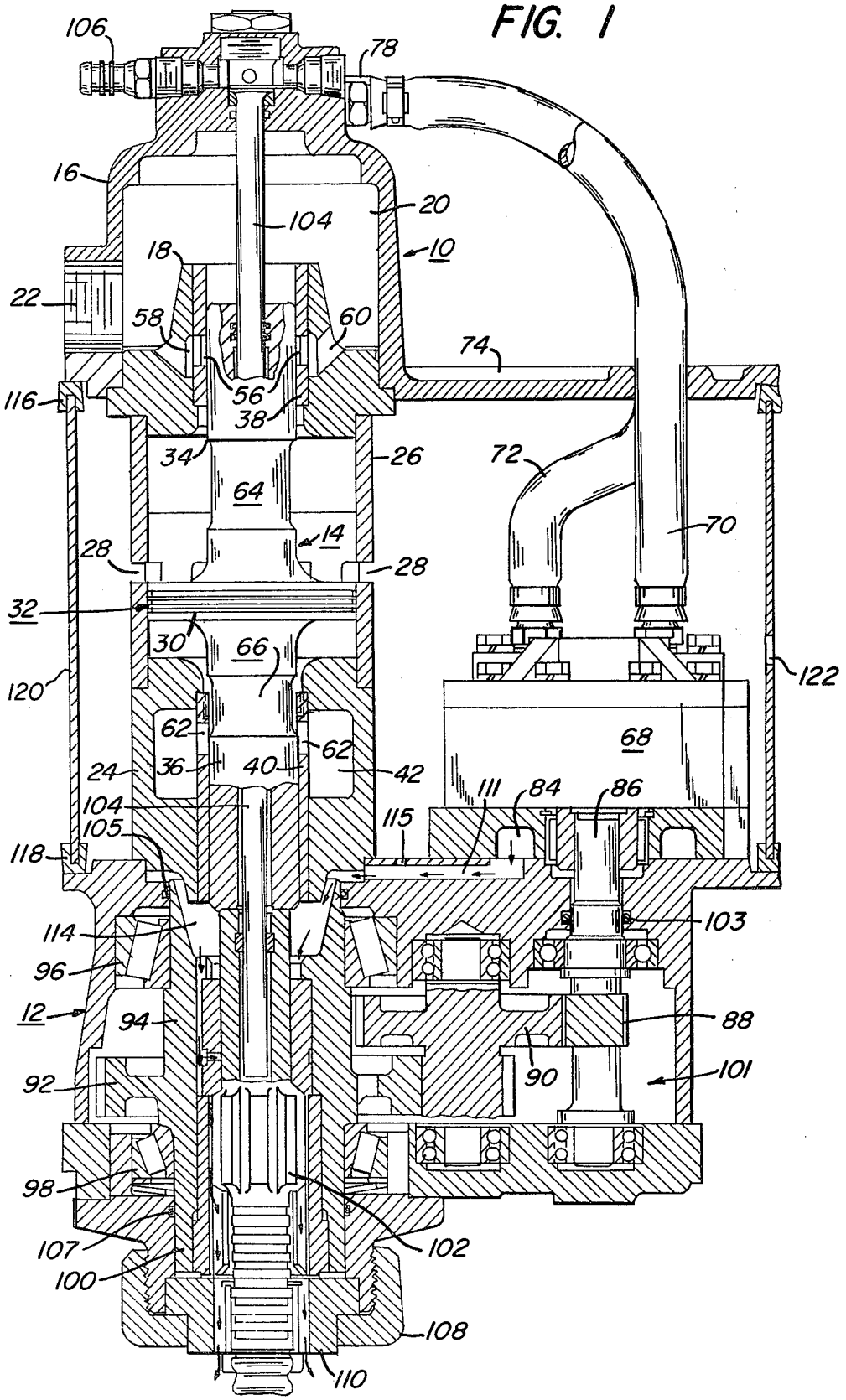
FIG. 1 is a vertical cross-sectional view of the pneumatic motor, rock drill assembly of the invention.
Figure 2:
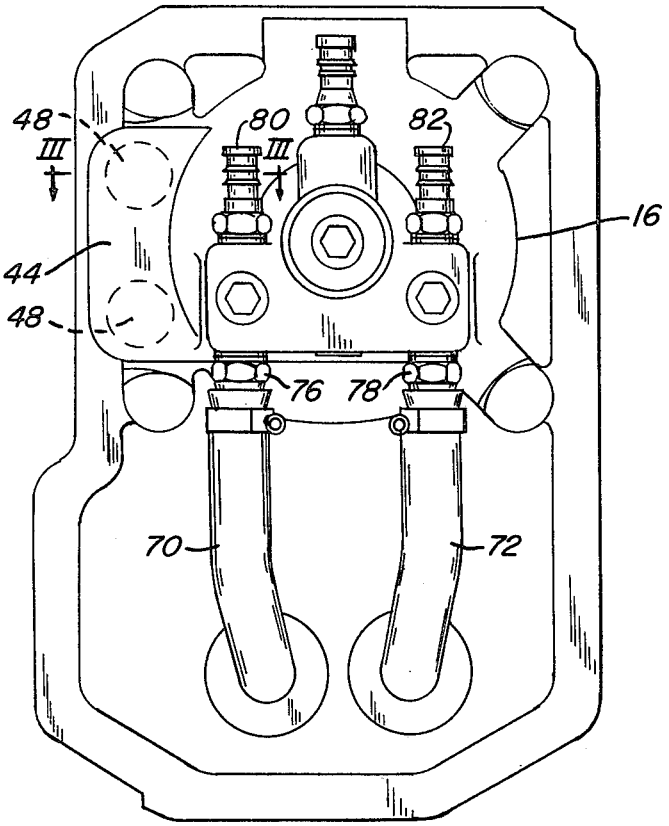
FIG. 2 is a top view of the apparatus shown in FIG. 1.
Figure 4:
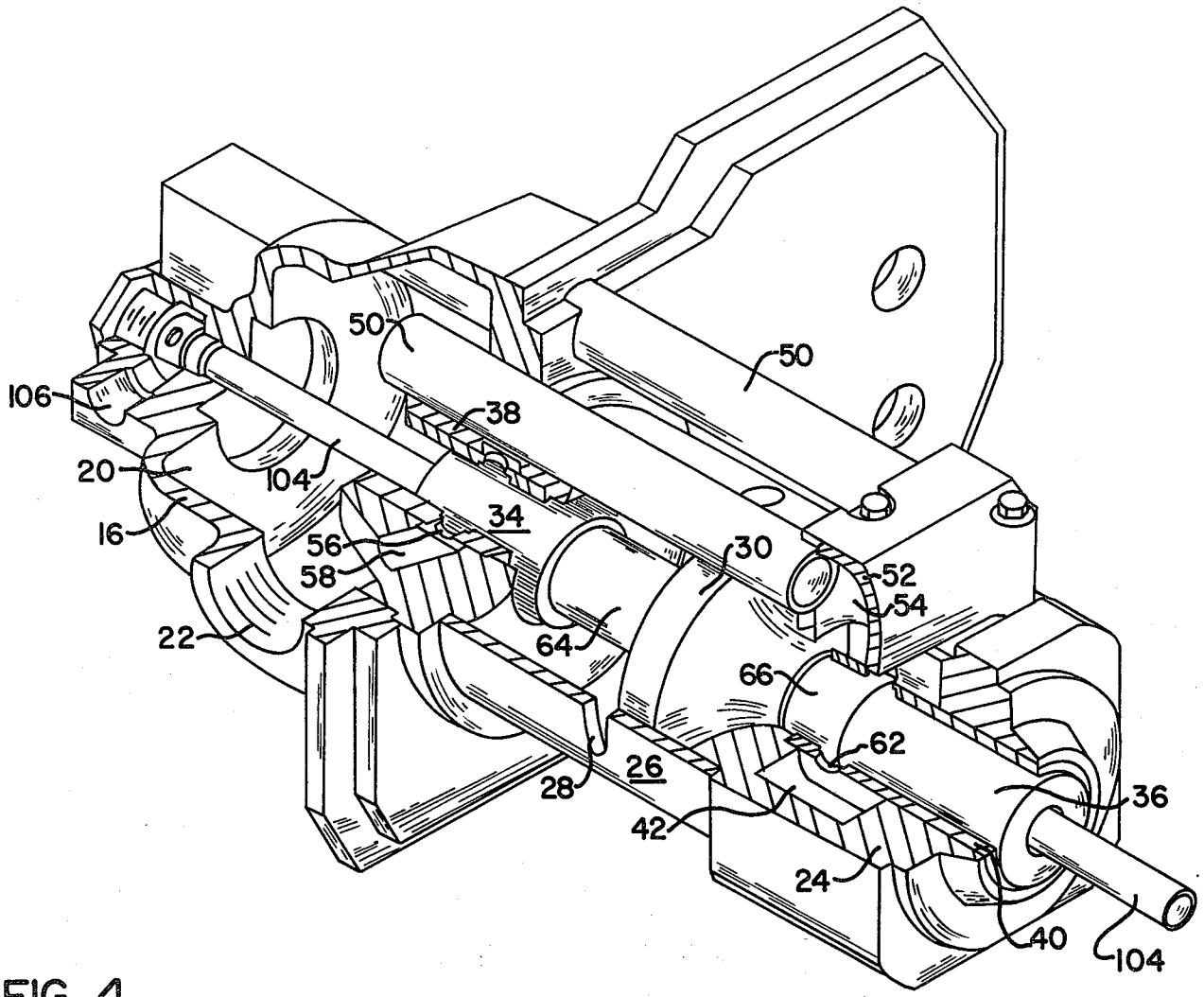
FIG. 4 is a partially broken away isometric view of the apparatus shown in FIG. 1.

With reference now to the drawings, and particularly to FIGS. 1, 2 and 4, there is shown a rock drill assembly comprising an upper housing 10, a lower housing 12 and an intermediate hammer piston and cylinder assembly, generally indicated by the reference numeral 14. The upper housing 10 includes a cup-shaped member 16 into which is fitted a generally circular bushing part 18 to provide a first or upper receiver chamber 20 adapted for connection to a source of external air pressure via an inlet port 22. Carried on the lower housing 12 is a second generally circular bushing part 24; and between the parts 18 and 24 is a cylinder section 26 comprising a simple tube having exhaust ports 28 formed therein.

Reciprocable within the cylinder 26 is the large diameter portion 30 of a hammer piston, generally indicated by the reference numeral 32. Extending axially on opposite sides of the enlarged-diameter piston portion 30 are reduced-diameter piston portions 34 and 36. Piston portion 34 reciprocates within a sleeve or liner 38 inserted into a bore in the part 18. Similarly, piston portion 36 reciprocates within a sleeve or liner 40 inserted into a bore in the part 24. Also formed in the part 24 and surrounding the liner 40 is a second receiver chamber 42.

Figure 3:
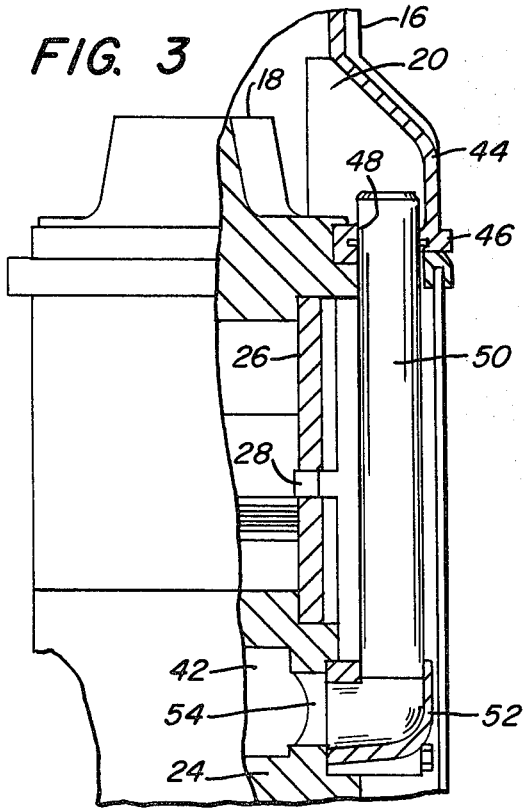
FIG. 3 is a cross-sectional view taken along line III—III of FIG. 2 showing one of two tubes which interconnect receivers at opposite ends of the reciprocating piston assembly.

As best shown in FIGS. 2 through 4, the housing portion 16 is formed with a side extension 44 having a lower flange 46 which rests on the periphery of part 18. Formed in the flange 46 are two openings 48 which receive thin-walled tubes 50, one of which is shown in FIG. 3. The other ends of the thin-walled tubes 50 are connected to an elbow 52 which connects the lower ends of the tubes with ports 54 extending through the part 24 and communicating with the lower receiver chamber 42. Thus, the tubes 50 interconnect the upper and lower receiver chambers 20 and 42 without the necessity for machining passageways in the cylinder assembly. At the same time, the tubing permits the cylinder 26 for the large diameter piston 30 to comprise a simple tube having only the exhaust ports 28 formed therein.

The upper liner 38 in part 18 is provided with ports 56 which communicate with an annular passageway 58 formed in the part 18. The passageway 58, in turn, is connected through port 60 to the receiver chamber 20. Similarly, the lower receiver chamber 42 is adapted to be connected to the interior of the cylinder formed by the liner 40 through ports 62. It will be noted that the reduced-diameter piston portions 34 and 36 have necked-down areas or portions 64 and 66. These cooperate with the ports 56 and 62 to alternately valve motive air to the upper and lower surfaces of the large diameter piston portion 30. That is, with the hammer piston 32 in the position shown in FIG. 1, the lower side of the large diameter piston portion 30 is connected to the receiver chamber 42 via the necked-down portion 66 and port 62. Under these circumstances, the lower side of the piston portion 30 is pressurized to force the hammer piston 32 upwardly while air exits through the exhaust ports 28. After the large diameter piston portion 30 closes off the exhaust ports 28, the air captured above it cushions the upward travel of the hammer piston.

Upward movement of the hammer piston will continue until the space above piston portion 30 is in communication with the upper receiver chamber 20 via the necked-down portion 64 and the ports 56. Now fluid under pressure is admitted to the top side of the large diameter piston portion 30, thereby forcing it downwardly; while air is again exhausted through the exhaust ports 28. After the lower edge of the piston portion 30 closes off the exhaust ports 28, the air beneath the piston portion 30 cushions the descent of the piston until its underside is again in communication with the receiver chamber 42, whereupon the cycle is repeated.

With the arrangement shown, the relatively large receivers 20 and 42 dampen any pressure fluctuations in the line and, at the same time, assure availability of air under pressure on demand from the valves. At the same time, and by virtue of the fact that the receivers are interconnected by the tubes 50, no machining of the cylinder 26 is required other than the formation of the exhaust ports 28.

Mounted on the lower housing 12 is a pneumatic or air motor 68 having two inlet ports connected through tubes 70 and 72 and openings in a flange 74 of housing 10 to fittings 76 and 78 which communicate with nipples 80 and 82 on the other side of the cup-shaped housing 16. The nipples 80 and 82, in turn, are adapted to be connected through suitable valving, not shown, to a source of fluid under pressure. When it is desired to rotate the pneumatic motor 68 in one direction, for example, air under pressure will flow into the motor through tube 70; whereas, when the reverse direction of rotation is desired, air under pressure will flow into the motor through tube 72. The internal structure of pneumatic motor 68 may be of any desired type which are currently known or may become known to those skilled in the art. In general, means fixedly secured to shaft 86 will be driven in one of two directions depending upon the direction of air impingement. The air with entrained oil is exhausted from the motor through an annular passageway 84.

The output shaft 86 of the fluid motor 68 is journaled in suitable bearings as shown and carries a pinion gear 88 which meshes with a cluster gear 90, also carried within suitable bearings. The cluster gear 90, in turn, drives a bushing gear 92 which forms an integral part of a circular bushing 94 carried on taper bearings 96 and 98 within the housing 12. The bushing 94 is provided with an internal, splined sleeve 100 which meshes with a splined striking bar 102. As the bushing 94 is rotated within bearings 96 and 98, so also will the striking bar 102 by virtue of its splined connection to the sleeve 100. At the same time, the striking bar 102 can be reciprocated by virtue of its splined connection to the sleeve 100 as it is repeatedly struck by the lower end of the hammer piston 32 which, as explained above, continually reciprocates as long as fluid under pressure is supplied to the receiver chambers 20 and 42. The gears 88, 90 and 92 are carried within a gearbox 101 provided with seals at 103, 105 and 107. Oil is poured into the gearbox which is sealed by the foregoing seals.

Extending through the hammer piston 32, as well as the striking bar 102, is a tube 104 provided with suitable O-ring seals as shown. Tube 104 is connected at its upper end to an inlet port 106 adapted for connection to a source of cleaning fluid, such as water. The fluid passes downwardly through the tube 104, the striking bar 102 and the drill rod itself to the drill bit where it is discharged onto the material being bored. Bushing 94 is held in place by a ring nut 108 in engagement with an annular bushing 110 which abuts the lower end of bushing 94.

Reverting again to the air motor 68, it will be remembered that exhaust air and oil from the motor are discharged into annular chamber 84. From this annular chamber, it is directed through passageway 111 in the bushing 12 into a space 114 surrounding the upper end of the striking bar 102 and the lower end of the reduced-diameter portion 36 of the hammer piston 32. This serves to lubricate the reciprocating parts in this portion of the assembly. Part of the exhaust air will escape through opening 115 in the upper wall of housing 12; while the remainder will leak past the striking bar 102 to the atmosphere along the path of the arrows shown in FIG. 1.

Surrounding the hammer piston assembly 14 and the pneumatic motor 68, and carried between grommets 116 and 118, is an aluminum sheath 120 provided at one point around its periphery with an opening 122. Air exhausted through the ports 28 enters the space enclosed by the sheath 120 and thence passes out through the opening 122, the space within the sheath acting to muffle the exhaust of air from the device. Air passing through opening 115, of course, also enters the space enclosed by sheath 120.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A pneumatic motor comprising a cylinder having exhaust ports therein, reduced-diameter cylinders coaxial with said first-mentioned cylinder at opposite ends thereof, receivers for fluid under pressure adjacent said reduced-diameter cylinders, inlet ports in said reduced-diameter cylinders for connecting the interior of each cylinder to its respective receiver, a hammer piston having an enlarged piston portion reciprocable within said first-mentioned cylinder, reduced-diameter piston portions extending axially on opposite sides of said enlarged piston portion and reciprocable within said reduced-diameter cylinders, means on said reduced-diameter piston portions for alternately connecting the respective receivers through said inlet ports to one and then the other side of said first-mentioned cylinder, conduit means external to said cylinders interconnecting said receivers and said conduit means comprises at least one tube interconnecting the respective receivers at a point radially offset with respect to said first-mentioned cylinder, and supply port means in communication with one said receiver for supplying motive fluid to said cylinder therethrough.

2. The pneumatic motor of claim 1 wherein the means on the reduced-diameter piston portions for alternately connecting the respective receivers to one and then the other side of said first-mentioned cylinder comprise necked-down portions on said reduced-diameter piston portions which connect their respective inlet ports to the first-mentioned cylinder as the enlarged piston portion approaches the respective inlet ports during its reciprocating movement.

3. The pneumatic motor of claim 1 wherein said reduced-diameter piston portions are integral with said enlarged piston portion.

4. A pneumatic motor comprising a cylinder having exhaust ports therein, reduced-diameter cylinders coaxial with said first-mentioned cylinder at opposite ends thereof, receivers for fluid under pressure adjacent said reduced-diameter cylinders, inlet ports in said reduced-diameter cylinders for connecting the interior of each cylinder to its respective receiver, a hammer piston having an enlarged piston portion reciprocable within said first-mentioned cylinder, reduced-diameter piston portions extending axially on opposite sides of said enlarged piston portion and reciprocable within said reduced-diameter cylinders, means on said reduced-diameter piston portions for alternately connecting the respective receivers through said inlet ports to one and then the other side of said first-mentioned cylinder, conduit means external to said cylinders interconnecting said receivers, and said receivers for fluid under pressure are of a size such that they provide motive air on demand and dampen pressure fluctuations.

* * * * *